US008612193B2

(12) United States Patent
Raghuraman et al.

(10) Patent No.: US 8,612,193 B2
(45) Date of Patent: Dec. 17, 2013

(54) PROCESSING AND INTERPRETATION OF REAL-TIME DATA FROM DOWNHOLE AND SURFACE SENSORS

(75) Inventors: Bhavani Raghuraman, Wilton, CT (US); Terizhandur S. Ramakrishnan, Bethel, CT (US); Kenneth E. Stephenson, Newtown, CT (US); Lalitha Venkataramanan, Stamford, CT (US); Jose Navarro, Loughton (GB)

(73) Assignee: Schlumberger Technology Center, Sugar Land, TX (US)

( * ) Notice: Subject to any disclaimer, the term of this patent is extended or adjusted under 35 U.S.C. 154(b) by 1017 days.

(21) Appl. No.: 10/442,216

(22) Filed: May 20, 2003

(65) Prior Publication Data

US 2004/0010374 A1 Jan. 15, 2004

Related U.S. Application Data

(60) Provisional application No. 60/382,185, filed on May 21, 2002.

(51) Int. Cl.

| | |
|---|---|
| ***G06G 7/48*** | (2006.01) |
| ***G01V 1/40*** | (2006.01) |
| ***G01V 3/00*** | (2006.01) |

(52) U.S. Cl.
USPC ..... 703/10; 702/11; 702/9; 324/303

(58) Field of Classification Search
USPC ..... 703/10; 324/303; 702/9, 11
See application file for complete search history.

(56) References Cited

U.S. PATENT DOCUMENTS

| | | | | | |
|---|---|---|---|---|---|
| 5,220,963 | A | * | 6/1993 | Patton | 175/24 |
| 5,581,024 | A | * | 12/1996 | Meyer et al. | 73/152.03 |
| 5,812,068 | A | * | 9/1998 | Wisler et al. | 340/855.5 |
| 5,983,164 | A | * | 11/1999 | Ocondi | 702/12 |

(Continued)

OTHER PUBLICATIONS

Nyhavn et al., SPE 62937 Reservoir Drainage with Downhole Permanent Monitoring and Control Systems. Real-Time Integration of Dynamic Reservoir Performance Data and Static Reservoir Model Improves Control Decisions, Oct. 1-4, 2000, SPE Annual Technical Conference and Exhibition, pp. 1-10.*

Athichanagorn, S. et al. "Processing and Interpretation of Long-term Data from Permanent Downhole Pressure Gauges". *SPE* 56419 (Oct. 1999), pp. 1-16.

(Continued)

*Primary Examiner* — Kamini S Shah
*Assistant Examiner* — Juan Ochoa
(74) *Attorney, Agent, or Firm* — Jakub M. Michna; Rachel E. Greene; Bridget Laffey

(57) ABSTRACT

In accordance with an embodiment of the present invention, a method of processing large volumes of data to allow for real-time reservoir management is disclosed, comprising: a) acquiring a first data series from a first reservoir sensor; b) establishing a set of criteria based on reservoir management objectives, sensor characteristics, sensor location, nature of the reservoir, and data storage optimization, etc.; c) identifying one or more subsets of the first data series meeting at least one of the criteria; and optionally d) generating one or more second data series based on at least one of the subsets. This methodology may be repeated for numerous reservoir sensors. This methodology allows for intelligent evaluation of sensor data by using carefully established criteria to intelligently select one or more subsets of data. In an alternative embodiment, sensor data from one or more sensors may be evaluated while processing data from a different sensor.

22 Claims, 13 Drawing Sheets

(56) References Cited

U.S. PATENT DOCUMENTS

| | | | | |
|---|---|---|---|---|
| 5,992,519 | A * | 11/1999 | Ramakrishnan et al. | 166/250.15 |
| 6,012,015 | A * | 1/2000 | Tubel | 702/6 |
| 6,125,079 | A * | 9/2000 | Birchak et al. | 367/35 |
| 6,257,332 | B1 * | 7/2001 | Vidrine et al. | 166/250.15 |
| 6,272,434 | B1 * | 8/2001 | Wisler et al. | 702/9 |
| 6,389,881 | B1 * | 5/2002 | Yang et al. | 73/40.5 A |
| 6,434,435 | B1 * | 8/2002 | Tubel et al. | 700/30 |
| 6,442,105 | B1 * | 8/2002 | Tubel et al. | 367/82 |
| 6,442,490 | B1 * | 8/2002 | Li et al. | 702/18 |
| 6,456,902 | B1 * | 9/2002 | Streetman | 700/282 |
| 6,470,274 | B1 * | 10/2002 | Mollison et al. | 702/7 |
| 6,519,568 | B1 * | 2/2003 | Harvey et al. | 705/1.1 |
| 6,584,837 | B2 * | 7/2003 | Kurkoski | 73/152.02 |
| 6,668,619 | B2 * | 12/2003 | Yang et al. | 73/40.5 R |
| 6,873,267 | B1 * | 3/2005 | Tubel et al. | 340/853.3 |
| 7,096,092 | B1 | 8/2006 | Ramakrishnan et al. | |

OTHER PUBLICATIONS

Bryant, I. et al. "Permanent Monitoring of a Waterflood Using Cemented Resistivity Arrays: Indiana, USA". *EAGE 63rd Conf. & Tech. Exhib.* (Jun. 2001) Paper M020, pp. 1-4.

Bryant, I. D. et al. "Utility and Reliability of Cemented Resistivity Sensors in Monitoring Waterflood of the Mansfield Sandstone. Indiana, USA". *SPE* 71710 (Sep.-Oct. 2001), pp. 1-16.

Bryant, I. D. et al. "Real-Time Monitoring and Control of Water Influx to a Horizontal Well Using Advanced Completion Equipped with Permanent Sensors". *SPE* 77522 (Sep.-Oct. 2002), pp. 1-16.

Raghuraman, B. et al. "Interference Analysis of Cemented-Permanent-Sensor Data from a Field Experiment". *EAGE 63rd Conf. & Tech. Exhib.* (Jun. 2001), pp. 1-4.

Ramakrishnan, T. S. et al. "Testing Injection Wells with Rate and Pressure Data". *SPE Formation Evaluation*, SPE 20536 (Sep. 1994), pp. 228-236; pp. 10-12; Supplement pp. 27-38.

* cited by examiner

| 205 | 210 | 215 | 220 |
|---|---|---|---|
| **First Data Series** | **Set of Criteria** | **Subsets** | **Second Data Series** |
| Sensor A:<br>Pressure Sensor | (a) Missing data points ($\Delta t$ > set acquisition time interval)<br>(b) $\Delta t$ = 1 day (data reduction)<br>(c) Abs($\Delta P/\Delta t$) > 0.2 psi/min<br>(d) Abs($\Delta P/\Delta t$) > 0.2 psi/hr<br>(e) Abs($\Delta P/\Delta t$) < 1 psi/day<br>(f) Every tenth data point<br>(g) P < 2000 psi (bubble point) | Subset 1A: Criteria (a), (sensor/acquisition unit malfunction)<br>Subset 2A: Criterion (b) (data reduction)<br>Subset 3A: Criterion (d) (time stamp and pressure data corresponding to a pressure transient significant at hour scale)<br>Subset 4A: Criterion (c) or (d) (pressure transients relevant at minute and hour time scale.<br>Subset 5A: Criterion (e) paired time stamp sets of initial and final point in a continuous data set satisfying this criteria (identify regions of stable operation)<br>Subset 6A: Criterion (f) or (g) (data reduction and periods of operation below bubble point | Second Data Series 1A: Subset 1A<br><br>Second Data Series 2A: Subsets 2A and 4A (allows display of a plot of reduced data set with relevant pressure transients at minute and hour time scale)<br><br>Second Data Series 3A: Subset 3A and a one day window of first series window around it (includes first series data accessed around flagged time stamped transient)<br><br>Second Data Series 4A: Average pressure for each region identified in Subset 5A |

FIGURE 2

| 405 | 410 | 415 | 420 |
|---|---|---|---|
| **First Data Series** | **Set of Criteria** | **Subsets** | **Second Data Series** |
| Sensor A:<br>Pressure Sensor<br>(P) | (a) Missing data points ($\Delta t$ > set acquisition time interval<br>(b) $\Delta t$ = 1 day (data reduction)<br>(c) Abs $\Delta P/\Delta t$ > 0.2 psi/min<br>(d) Abs $\Delta P/\Delta t$ > 0.2 psi/hr<br>(e) Abs $\Delta P/\Delta t$ < 1 psi/day<br>(f) Every tenth data point<br>(g) P < 2000 psi (bubble point)<br><br>(h) Abs $\Delta V$>5%/min<br>(i) V> 10%<br>(j) V=0 | Subset 1A: Criteria (a),<br>Subset 2A: Criterion (b)<br>Subset 3A: Criterion (d)<br>Subset 4A: Criterion (c) OR (d)<br>Subset 5A: Criterion (e)<br>Subset 6A: Criterion (f) OR (g) | Second Data Series 1AB: Subset2A AND Subset 1B (reduced data for periods when valve is closed)<br><br>Second Data Series 2AB: Subsets 5A AND Subset 2B (steady pressure region when valve is open more than 10%)<br><br>Second Data Series 3AB: Subset3B (pressure transients relevant at minute scale or valve transients where valve opening changed by more than 5%) |
| Sensor B:<br>Valve Sensor<br>(V) | | Subset 1B: Criteria (j)<br>Subset 2B: Criterion (i)<br>Subset 3B: Criterion (c) OR (h) | |

FIGURE 4

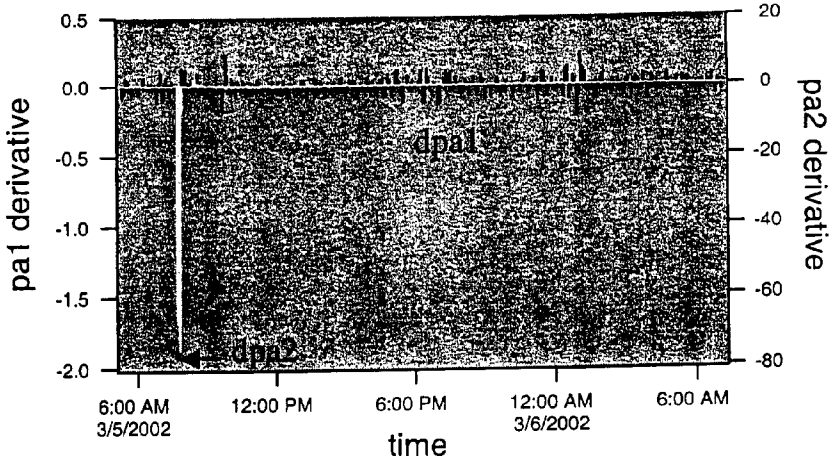
(b)
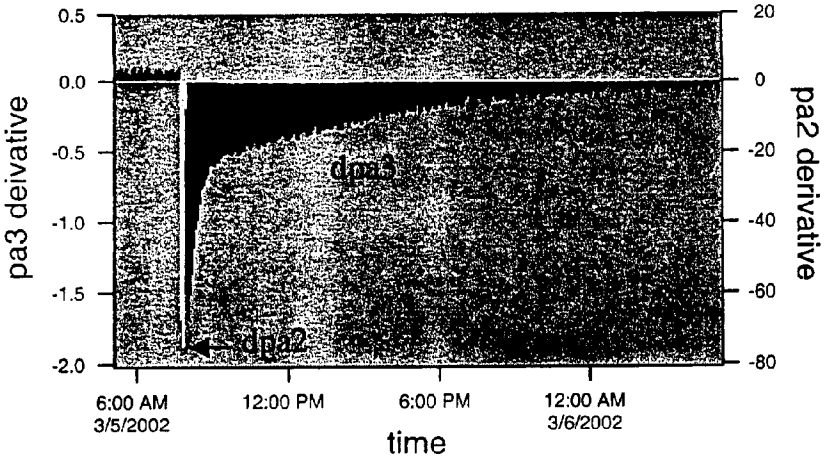
(a)
FIGURE 8

$t_f$ = 0.33 mm (a)

3.28 mm (b)

32.8 mm (c)

PROCESSING AND INTERPRETATION OF REAL-TIME DATA FROM DOWNHOLE AND SURFACE SENSORS

RELATED APPLICATION

This patent application claims priority from U.S. Provisional Patent Application Ser. No. 60/382,185 filed May 21, 2002.

FIELD OF THE INVENTION

The present invention relates to a method of processing large volumes of data to allow for real-time reservoir management. More particularly, it relates to tools and methods to process and interpret continuous streams of data from reservoir sensors.

BACKGROUND OF THE INVENTION

The development and installation of downhole and surface sensors to measure pressures, temperatures, voltages, etc. requires methods to process and interpret gigabytes of continuous data streams. The introduction of permanent sensor technologies allows data to be collected continuously at high frequencies over long periods of time, resulting in the generation of gigabytes of data that become difficult and time consuming to interpret on a continuous basis. The practice, therefore, has been either to reduce the frequency of acquisition to get manageable data sets or to access and interpret data subsets only where a known transient is introduced, such as a well test. Under these conventional methods, the full value of the sensors is not realized because interesting regions in the data may be missed. These regions may contain significant information about the reservoir and wellbore.

Athichanagorn, Horne and Kikani disclose a wavelet technique to identify transients in continuous data streams in "Processing and Interpretation of Long Term Data from Permanent Downhole Pressure Gauges", SPE Annual Technical Conference and Exhibition, Houston, Tex., Oct. 3-6, 1999, SPE56419 (incorporated by reference herein in its entirety). However, this method analyzes the entire data set at specific time scales. The time scales are chosen by the specific wavelet transform and are independent of sensor physics or the objective of measurement interpretation. Athichanagorn et al. also use a preprocessor to filter out the noise that could erroneously also remove sharp low amplitude transients, which may be relevant for reservoir evaluation. The data processing algorithms used in accordance with the present invention generates a few relevant subsets using relevant criteria and, preferably, at a few time scales. The algorithms are flexible and relevant criteria used to develop the data subsets can be adjusted over the lifetime of the reservoir. These algorithms work on raw signal data and require no preprocessing or filtering. Moreover, they generate compressed data sets as outputs that can be tailored for different end users.

In conventional methods, data interpretation usually involves history matching with full-field reservoir simulators. This could take months. In real-time reservoir management, it is preferable to take corrective measures at much faster time scales.

Accordingly, it is an object of the present invention to allow for efficient data processing and data interpretation for real-time monitoring/reservoir evaluation.

It is another object of the present invention to provide tools and methods for processing and interpreting these vast sets of data so as to extract all the useful information in the most efficient way. These tools work both when data streams arrive continuously as well as when the archived database is accessed periodically.

It is yet another object of the present invention to provide interpretation methodologies at varying levels of detail, ranging from quick look interpretations over a time scale of days to detailed modeling over a time scale of months, so that the information from the sensors can be used effectively and their full benefits realized.

SUMMARY OF THE INVENTION

Real-time monitoring may be divided broadly into three areas: (1) data acquisition, (2) data processing and (3) data interpretation. Important issues to be addressed in designing data acquisition processes are summarized in commonly owned U.S. Pat. No. 7,096,092 (incorporated by reference herein in its entirety, "the '092 patent"). However, to date, there are no adequate real-time methods to process or interpret the large volumes of data collected from reservoir sensors.

For the purposes of this invention, real-time does not require that data be delivered to the user immediately on acquisition; the acquired data could be available as a continuous stream or it could be periodically uploaded/delivered to a central server and archived. Based on needs and end use, the user defines what is real-time for his application and accesses the database accordingly. For example, when a well is brought on-stream, a production engineer would want continuous access to the data streams; however, once the well is in a steady production mode, the engineer would likely want to access the data sets only once a day, comfortable in the knowledge that automatically triggered alarms as discussed in the '092 patent would alert him to any problems. Notwithstanding the foregoing, as will be discussed below, for archiving purposes, it is preferred that data be acquired and stored at highest practical frequency.

In accordance with a first embodiment of the present invention, a method of processing large volumes of data to allow for real-time reservoir management is disclosed, comprising: a) acquiring a first data series from a first reservoir sensor; b) establishing a set of criteria based on at least one of the group consisting of reservoir management objectives, sensor characteristics, sensor location, nature of the reservoir, and data storage optimization; c) identifying one or more subsets of the first data series meeting at least one of the criteria; and optionally d) generating one or more second data series based on at least one of the subsets. This methodology may be repeated for one or more additional reservoir sensors.

In a second embodiment, a method of processing large volumes of data to allow for real-time reservoir management is disclosed, comprising: a) acquiring a first data series from a first reservoir sensor; b) establishing a set of criteria based on at least one of the group consisting of reservoir management objectives, sensor characteristics, sensor location, nature of the reservoir, and data storage optimization; c) examining the first data series to identify one or more regions of interest based on at least one of the criteria; d) accessing said acquired first data series corresponding to the one or more regions of interest; and e) generating one or more second data series based on said accessed first data series. Optionally (d) may further include generating one or more subsets corresponding to one or more regions of interest and, accordingly, (e) may further include generating the second data series based on one or more of these subsets.

To ease in the handling of data, it may be preferable to merely identify the start and stop points of the region of interest and then access the subset containing these start and stop points as well as the points therebetween. Thus, only significant segments of the large data volumes need to be considered at any given time. It is noted that the accessed subset may be broader or narrower than the region of interest, depending on the processing to be performed on the data.

In a third embodiment, large volumes of data collected from more than one reservoir sensor may be processed using a common set of criteria. Accordingly, a method of processing large volumes of data to allow for real-time reservoir management is disclosed, comprising: a) acquiring a plurality of first data series from a plurality of reservoir sensors; b) establishing a set of criteria; c) identifying one or more subsets of the plurality of first data series meeting at least one of the criteria; and d) generating a plurality of second data series based on at least one of the subsets. This embodiment allows for data to be more intelligently evaluated by using carefully established criteria to intelligently select one or more subsets of data, and in particular, allows for sensor data to be evaluated while considering data from a different sensor.

Careful selection of criteria allows for the generation of compressed data sets with varying level of details, customized for various end users with different application needs. For example, it may be preferable to evaluate the data using criteria of different scales of a common parameter. Minute and hour intervals may be chosen for the time parameter; inches and feet may be chosen for the length parameter; psi and kpsi may be chosen for the pressure parameter. The criteria chosen depend on (but are not limited to) reservoir management objectives (such as diagnosing hardware/software/telemetry/sensors, monitoring formation characteristics, optimizing production, planning future development of the field, optimizing data collection/storage), sensor physics, and/or the reservoir system under consideration.

The present invention also provides a methodology for data interpretation of continuous data streams. As mentioned above, the conventional methods of performing detailed history matching and rigorous modeling using full field simulators could take a time scale of months to fully develop and analyze. To better handle the data, conventional methods omit, for example, continuous measurements made at time scales of seconds and minutes from the analysis, thereby not realizing the full value of continuous data streams. The method disclosed herein suggests interpretation at varying level of details, ranging from quick look interpretations over a time scale of days to detailed modeling over a time scale of months. Quick-look interpretation is done by extracting relevant derived quantities from measured data (eg. pressure response lag time in interference tests, productivity index etc.) in the interesting data windows identified through data processing. These quantities are also tracked over a long period of time (preferably the reservoir lifetime) to look for changes in reservoir behavior. At an intermediate level, results of quick look interpretation may be used to constrain formation properties by running multiple forward models and/or inversion algorithms to simulate these local events. Over a longer time scale of months, detailed history matching may be employed. Accordingly, the data may be interpreted by (1) identifying one or more regions of interest within the subset of data and accessing stored time-stamped compressed batch files corresponding to these regions of interest; (2) extracting parameters indicative of reservoir behavior derived from the data (the first data series, the second data series, the stored time-stamped compressed batch files or the subset of data); (3) tracking these parameters over time; (4) performing modeling/inversion using such parameters and the data in the regions of interest of (1); and/or (5) a regression analysis/history match with a detailed reservoir model using the entire data set or a significantly larger data window than in the modeling. The modeling of (4) may include running multiple forward models and/or inversion algorithms to simulate one or more subsets of data, the objective being to constrain reservoir properties using data or derived parameters.

Further features and applications of the present invention will become more readily apparent from the figures and detailed description that follows.

BRIEF DESCRIPTION OF THE DRAWINGS

FIG. 2 is a table showing an example of the embodiment of FIG. 1.

FIG. 4 is a table showing an example of the embodiment of FIG. 3.

FIGS. 8(*a*) and 8(*b*) are graphs of the cross-correlation of pressure derivative signals in a three-zone well.

DETAILED DESCRIPTION OF INVENTION

Figure 1:
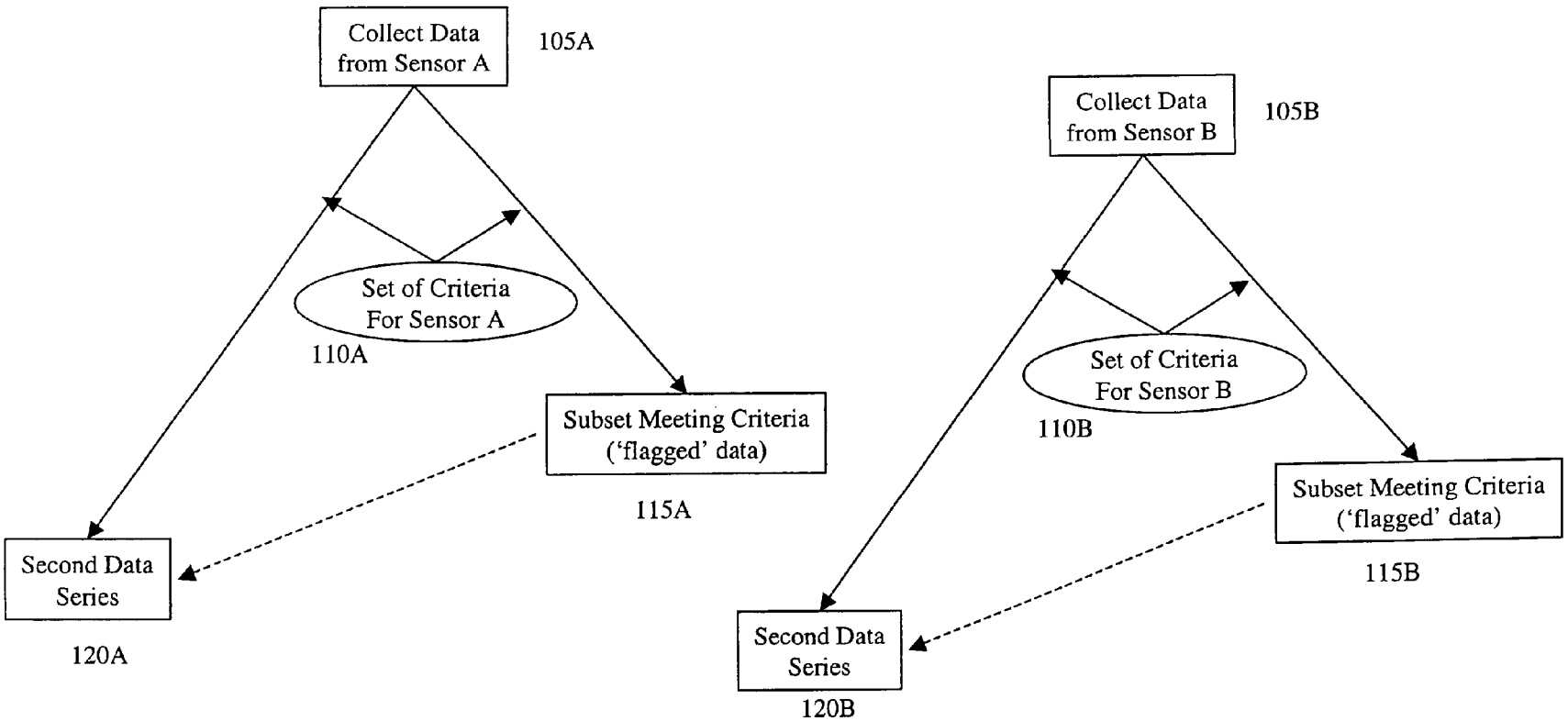
FIG. 1 is a flow chart showing a first embodiment of the present invention.

Turning now to FIG. 1, there is shown a non-limiting first embodiment of the present invention. As shown as box 105A a first data series is collected from reservoir sensor A for processing. This sensor may be any type of reservoir sensor, including surface mounted sensor or a downhole sensor, either permanently or temporarily installed, that monitors some reservoir property, including (but not limited to) formation characteristics, fluid characteristics or production characteristics. A set of criteria is established for this sensor as shown as 110A, which may be based on the formation properties, the nature of the sensor (such as sensor physics), location of the sensor, or some other characteristic established by the data processor (i.e. the user). These criteria may serve as thresholds to identify transients, slow trends, missing data points or any other data points that may be of interest to the user. In general, the set of criteria is carefully established to intelligently create subsets of data 115A. These subsets may provide information regarding the production of a reservoir, changes in reservoir characteristics, and changes in hardware operation. For example, if the criteria of missing data points is chosen (i.e., $\Delta t$ greater than the set acquisition interval) to evaluate data from a pressure sensor, the identification of a subset meeting this criteria may indicate that sensor/acquisition unit has malfunctioned. Additional criteria may include (but is not limited to) criterion related to time intervals, pressure, temperature, sensor noise, valves opening or closing, gradients in pressure and may include different scales or functions of these parameters (an example criteria set is shown in FIGS. 2 and 4, discussed below).

Accordingly, one or more subsets of data points meeting one or more of the criteria may be developed as shown as 115A. Optionally, the second data series 120A may be derived from one of the subsets of 115A or may be developed using a criteria from 110A or both. It is noted that this step may be omitted if the subset is equivalent to the second data series required for further analysis or interpretation. This process may be repeated for one or more additional reservoir sensors 105B as shown in FIG. 1 as 110B, 115B, and 120B.

FIG. 2 shows a table describing an example of the development of one or more second data series wherein separate criteria are developed to evaluate each sensor. In the first column 205, a first data series is acquired from sensor A (a pressure sensor). As shown in column 210, a set of criteria is developed for the pressure sensor based on the nature of the sensor, the physical parameters of the sensor, the reservoir system in general and/or reservoir management objectives.

Criteria (a) (column 210 of FIG. 2) is designed to identify missing data points, and is used to generate subset 1A (see column 215). Second data series 1A consists only of subset 1A and, for example, may be used for diagnostic purposes. Likewise, criterion (b) is designed to assist in data storage optimization, while criterion (c) and (d) are designed to identify relevant pressure transients and monitor formation characteristics (a reservoir management objective). Because criterion (c) identifies relevant transients at the minute scale, it is designed to monitor sharp changes in pressure. By contrast, criterion (d) identifies relevant transients at the hour scale and therefore identifies slower transients in the pressure. Accordingly, subset 2A is intelligently selected to allow for data reduction while subset 4A is intelligently selected to allow for identification of sharp transients and slow transients. The combination of these subsets is shown in second data series 2A which allows the display of a plot of reduced data with relevant pressure transients at the minute and hour time scale and may be useful for further analysis or interpretation.

It is noted that the second data series may be based on one or more subsets and, if desired, may be further based on one or more of the criteria. Further, the second data series may be some processed form of the raw data, see second data series 4A in column 220. Each second data series may be customized to provide an input of specific information for further analysis or interpretation.

Figure 3:
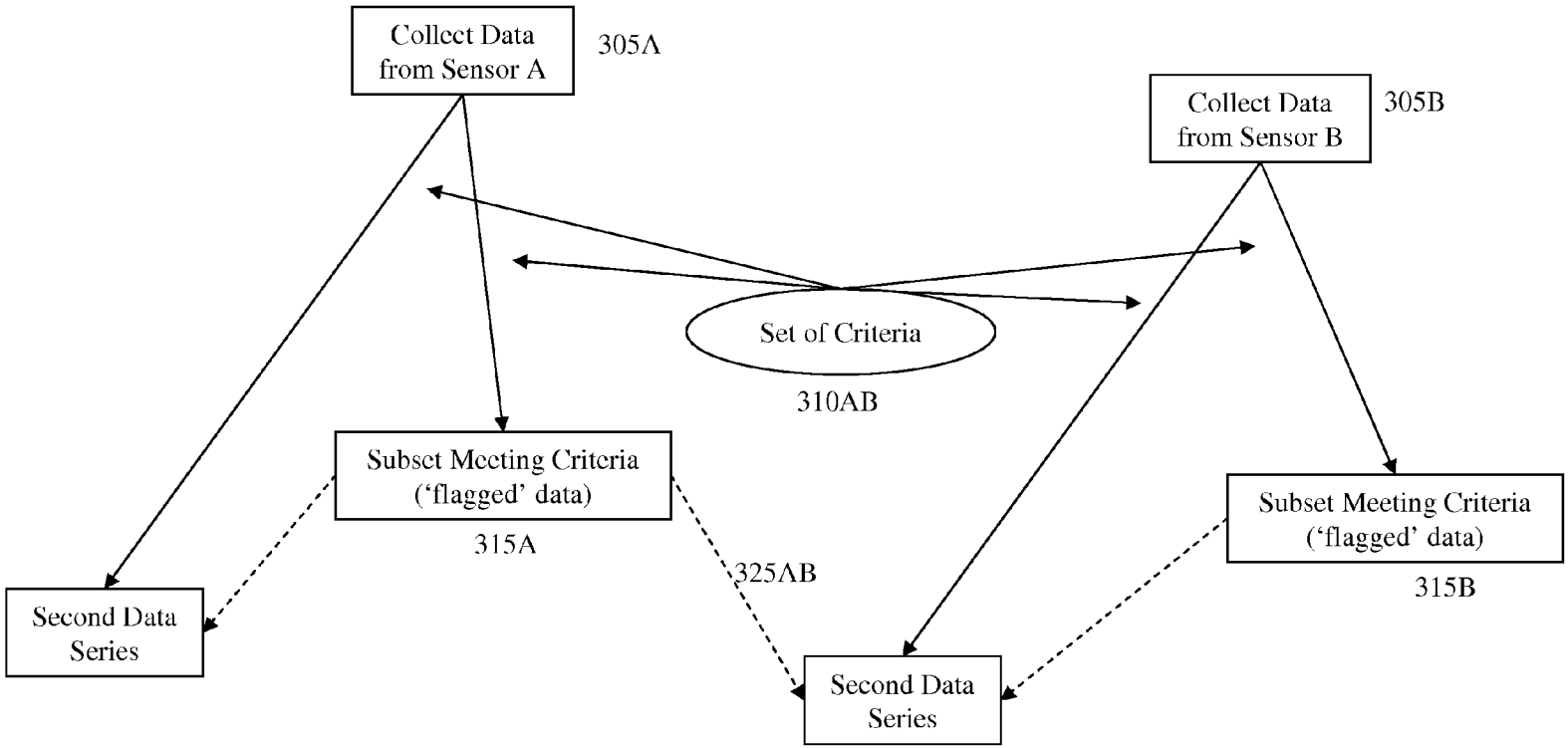
FIG. 3 is a flow chart showing a second embodiment of the present invention.

Another second embodiment is shown in FIG. 3 wherein one or more sensors 305A, 305B are processed using a common set of criteria 310AB. This scenario allows for a more intelligent interpretation of the data by cross-correlation of sensors. For example, changes to sensor A may be attributable to an event occurring in the vicinity of sensor B, such as changes in pressure sensed by A due to a valve opening at/near sensor B. Accordingly, well site events and apparent transients (as discussed below) may be more intelligently assessed using a jointly correlated set of criteria as suggested in the configuration of FIG. 3.

In an alternative of the second embodiment, the second data series is generated using a subset of data developed from a different sensor, shown as dashed line 325AB in FIG. 3.

FIG. 4 shows a table describing an example of the development of one or more second data series wherein a common set of criteria is used to evaluate a group of sensors. In this example, the first data series are from sensors A (a pressure sensor) and B (a valve sensor) as shown in column 405. A joint set of criteria is developed (see column 410) and various subsets are developed (see column 415). (It is noted that the joint criteria may be developed from a single condition affecting more than one sensor.) Because a common set of criteria are developed, second data series (see column 420) may developed wherein data from one sensor is used to evaluate the other sensor (see second data series 1AB and 2AB).

It is noted that changes in sensor physics and reservoir characteristics (such as during the production of the well) may necessitate an adjustment of the criteria as data is gathered. For example, it may be determined that the noise in the sensor interferes with the sensor output so that data points of the first data series that exceed a threshold criteria go unnoticed as the threshold may have to be set very high. Likewise, a threshold criteria may be set too low, so that the subset (i.e, 115A, 115B, 315A, or 315B) is identical to the first data series. Similarly, it may be determined that additional criteria are more significant than the originally established criteria (i.e., temperature is a more significant criteria than pressure). Accordingly, the set of criteria may be adjusted by adding, deleting or changing criterion as the user develops information about the well, the formation, the sensor, the completion hardware, etc.

The scenarios of FIGS. 1-4 also allow for intelligent acquisition of sensor data. While it is preferred that data from reservoir sensors be acquired as frequently as possible, telemetry logistics, data storage, sensor physics and reservoir characteristics may limit the frequency at which data may be feasibly collected. Accordingly, the system may be designed to collect data at a less preferable, slower acquisition rate. For example, the acquisition rate may be temporarily increased upon the identification of data point(s) meeting one of the criteria to allow for a more detailed look at the fluctuation in pressure. Once the transient returns to a level below the threshold criteria, the acquisition rate may be returned to the original rate.

As will be discussed below, in one example of the method of the present invention, the set of criteria includes two different time scales (and perhaps other criteria), such as a minute time scale and an hour time scale. Accordingly, if only the minute scale criteria is chosen to evaluate the first data series, then the second data series is equivalent to a subset containing significant pressure transient at the minute time scale. It is noted that it may be preferable to chose both time scales and create two subsets, one at the minute time scale and one at the hour time scale and then use both subsets to create a second data series showing both time scales.

It may be preferred to store the acquired data for later retrieval, such as upon the identification of a region/window of interest. Accordingly, in another embodiment, data from a first reservoir sensor is examined to identify one or more regions of interest based on at least one of a set of criteria. Once these regions of interest are established the raw data (the first data series) is accessed corresponding to this region of interest and one or more subsets are developed. This subset may include only data within the region or may include data "near" this region of interest.

Figure 5:
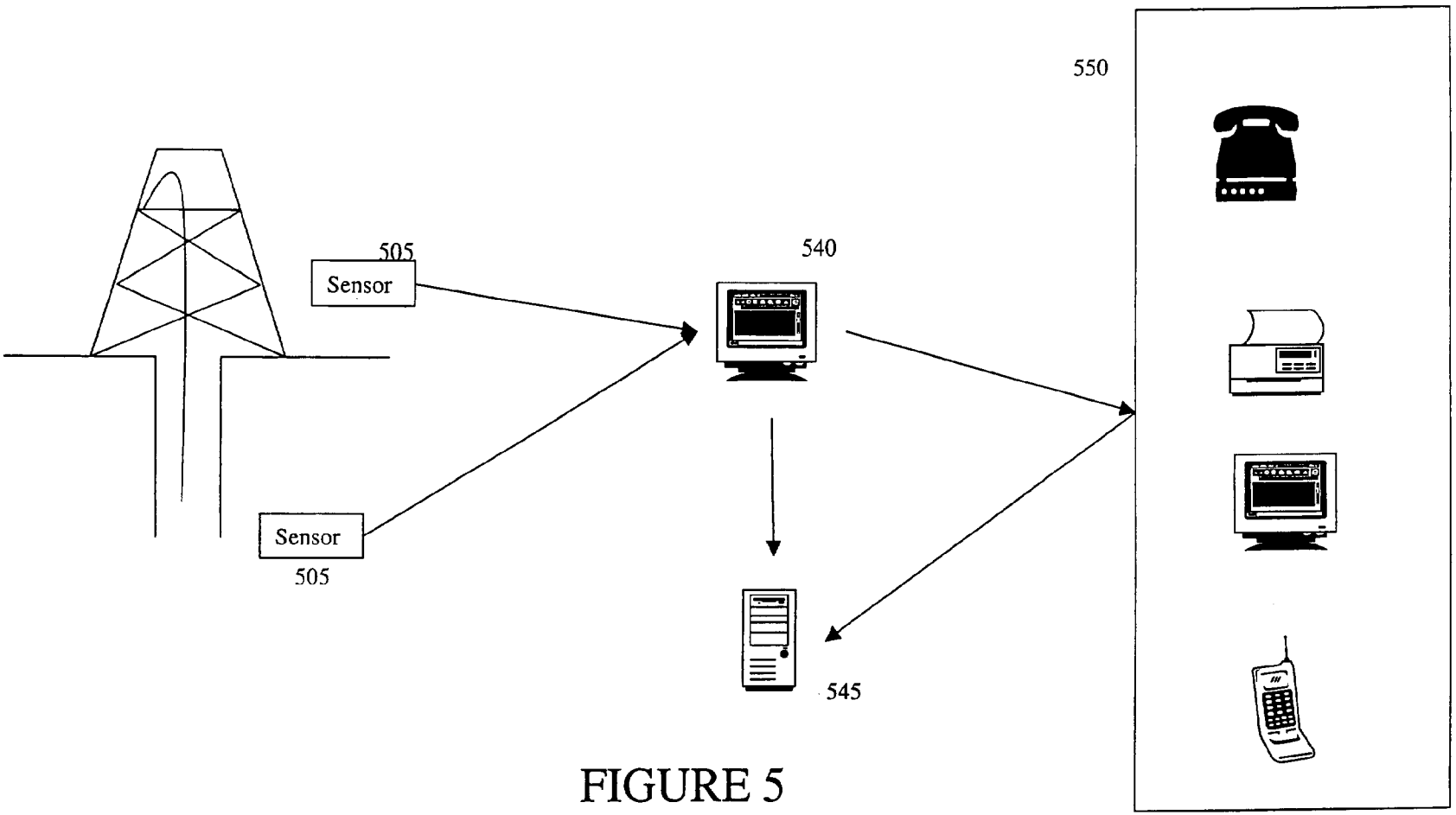
FIG. 5 is a schematic showing the storage and display of sensor data.

As shown in FIG. 5, the data collected from reservoir sensors 505 may be downloaded to a processing unit 540 (which may be locally or remotely located) and stored at a remote server 545. The stored data may be time-stamped and compressed to allow for easy access and storage. It is preferable that the data be stored in its rawest form, i.e. the acquired first data series with no data loss; however, the subset of data or the second data series may also be similarly stored. It may be preferable to display one or more second data series, one or more first data series, one or more subsets (or any combination thereof) either at the well site or remotely 550 to a printer, computer, or a portable device, such as a cellphone or laptop computer. Further, it may be desired to establish a notification system, such as that described in the '092 patent.

It may be preferable to establish a basis by which to access archived data, such as by time stamping or otherwise identifying the data. One simple way to perform this bookkeeping is to time-stamp the data; however, one skilled in the art would recognize that there are other ways to identify the data for later retrieval. This bookkeeping is particularly important where data is collected from multiple sensors so that there is a common basis for comparing the collected data. For multiple sensors wherein time is not a key linking factor, the data series may be correlated using some other common parameter. Likewise, multiple data series may be correlated by jointly compressing the data, such as into linked data files or common data files.

The following paragraphs provide more detailed examples of this data processing as well as some preferred interpretation methods.

Example A

Data Processing:

The method described here can be adapted to any sensor measurement and any criteria/parameter. For illustration purposes, however, the present example will focus on examples using criteria based on various time scales and cross-correlation. The example is based on pressure data streams obtained from two real-time monitoring experiments conducted by Schlumberger as disclosed in:

1. Raghuraman, B., and Ramakrishnan, T. S., (2001), *Interference Analysis of Cemented-Permanent-Sensor Data from a Field Experiment*, (M019), Jun. 11-15, 2001, EAGE 63rd Conference & Technical Exhibition, Amsterdam (incorporated by reference herein in its entirety).
2. Bryant, I. D., Chen, M.-Y., Raghuraman, B., Schroeder, R., Supp, M., Navarro, J., and Raw, I., *Real-Time Monitoring and Control of Water Influx to a Horizontal Well Using Advanced Completion Equipped With Permanent Sensors*, SPE 77522, Sep. 29-Oct. 2, 2002, SPE Annual Technical Conference and Exhibition, San Antonio (incorporated by reference herein in its entirety).
3. Bryant, I. D., Chen, M.-Y., Raghuraman, B., Raw, I., Delhomme, J.-P., Chouzenoux, C., Manin, Y., Pohl, D., Rioufol, E., Oddie G., Swager, D. and Smith, J (2001b), *Utility and Reliability of Cemented Resistivity Sensors to Monitoring Waterflood of the Mansfield Sandstone, Indiana*, SPE 71710, Sep. 30-Oct. 3, 2001, SPE Annual Technical Conference and Exhibition, New Orleans (incorporated by reference herein in its entirety).

Pressure can vary rapidly and transients can be significant from second-time scale to day-time scales. Accordingly, proper development of criteria is important to the achievement of the key objectives of real-time monitoring, which may include improving reservoir knowledge for efficient reservoir and field management and wellbore operation diagnostics. Further, because it is necessary to efficiently scan vast amounts of data and identify interesting regions for further interpretation, special care should be taken in selecting time scale-dependent criteria.

As discussed above, an interesting region (or subset) in a first data series may be defined as a region where a sharp transient occurs, where a slow trend develops, or where sensor data is relatively stable. These regions of interest can be a response in other data streams or the response to an event in some other part of the field. The nature of the response and its characteristics gives information about the reservoir. Sharp transients are detected using smaller time scales (i.e. minute-time scales) while slow trends are detected over a longer period of time (i.e. time scales of days). For example, the failure of an injection pump is an event that is detected as a sharp transient in the injection flow stream. Here, the relevant time scale criterion is minutes. By contrast, the shutting in of a producing well is an event that will cause responses in pressure streams measured in neighboring regions. For wells close to the shut in well, the relevant time scale may be minutes. For a pressure stream far away from this producing zone, the transient could be slow and would need to be analyzed at the hour time scale.

Data processing thus involves identifying data windows with transients at various relevant time scales and therefore requires that various time-dependent criteria be established. Referring back to FIGS. 2 and 4, the set of criteria 210 and 410 include various time scales, which may be selected depending on the nature of the parameter/sensor analyzed. Further, these criteria may be adjusted as more information becomes available about the reservoir behavior and sensor responses or as reservoir management objectives change or there are changes in the production of the well or well hardware, etc.

Because the data volumes can be very large to work with, it may be preferable to include a criteria allowing for the decimation or binning of the data. Decimation criteria may be selected based on reservoir management objectives, sensor characteristics, sensor location, nature of the reservoir, and data storage optimization, etc. However, this decimation may be performed by decimating to a minute-scale data set or other time scale or interval, or may be established by decimating every $n^{th}$ data point. The decimated data may be analyzed at a few time scales of interest, depending on the criteria chosen. It is noted that these relevant time scales may be different for different sensors and may be selected based on the reservoir system being studied. It is a learn-as-you-go process and time scales may be modified at a later point in time (such as by adjusting the criteria). In one embodiment, the first data set may be decimated and evaluated to determine whether any of the other criteria are met. In a preferred method of binning, the binning width (one in the set of criteria) is selected based on the signal to noise ratio. One skilled in the art would recognize that similar criteria relating to smoothing, filtering, etc. may also be established.

Note that the selection of criteria and/or subsets may follow Boolean logic; accordingly, careful selection of criteria and use of the "and" or "or" functions can result in very different subsets (see Subsets 4A, 6A and Second Data Series 2A of FIG. 2).

Note that it may be preferable to evaluate or process the first series data using threshold-type criteria chosen when there is no disturbance in the system.

One or more second data series may be generated which include any combination of subsets (including multiple time scales) and may further include any additional criteria. In addition, the second data series may include some processed version of the subset of data, such as statistics on maximum/minimum pressures, average values, etc. The size of the first data series evaluated can vary from a few hours worth of data to a few days depending on the how the acquisition system is set up and how often the user accesses it. If the algorithm detects a region of particular interest to the user in which the user wishes to analyze in greater detail, the user can go back to the archived first data series to extract that particular subset of the data.

These data processing algorithms are flexible and easy to use on any kind of signal. They work on raw data (first data series) in the time domain and do not require any preprocessing. Further, because the first data series are permanently archived, the processing and compression need not be reversible. Key features of these algorithms and some examples of their applications are summarized below:

1. Data analyzed at a few selected (but not necessarily all) time scales to identify interesting windows; the choice of time scales is based on sensor physics, location and is refined over time.
2. One or more interesting subsets of data are used to create second data series, which can be later used for data interpretation
3. Compressed second data series and/or its plot can be generated for different users at varying levels of detail. For example:
   (a) A second data series and/or its plot could be a daily data series and all significant events at the minute and hour time scales within a day could be generated for reservoir/production engineers analyzing the well and immediate region and making decisions on optimizing well production. If a minute-scale event is identified as useful for further interpretation, the user has an option to go into the archive to extract the first data series in that region for examining finer details.
   (b) Daily data series and/or its plot could be generated for a user planning large-scale field development and who is not interested in events occurring at minute and hour time scales.
   (c) Weekly/monthly plots for an asset manager
4. Diagnostics: In addition to the direct measurements, one could apply these algorithms to derived quantities. An example could be to plot the difference in annular pressures in two zones isolated by a packer. Transients may be used to track packer performance and identify potential failure of packer. Note that high-level alarms, such as complete packer failure, pressure exceeding safety limits, etc., should be part of the data acquisition procedures and monitored on a continuous basis.
5. Tracking sensor noise: By tracking flag counts (e.g. data meeting certain criterion) during periods when there are no transients, one can keep track of signal noise levels over the lifetime of the reservoir.
6. The same processing may also be applied to a plurality of first data series whose signals may potentially be related to each other. For example, one could process a multiple first data series from pressure sensors in a set of neighboring wells. A second data series may be generated where common subsets from all first data series are retained even if only one or some of the first data series is identified or flagged. This will allow analysis of responses of all pressure sensors to these one or more flagged events and also allow for cross-correlation of sensor data. Hence, with pressure data this would yield quick look information about connectivity between these multiple wells.

Figure 6:
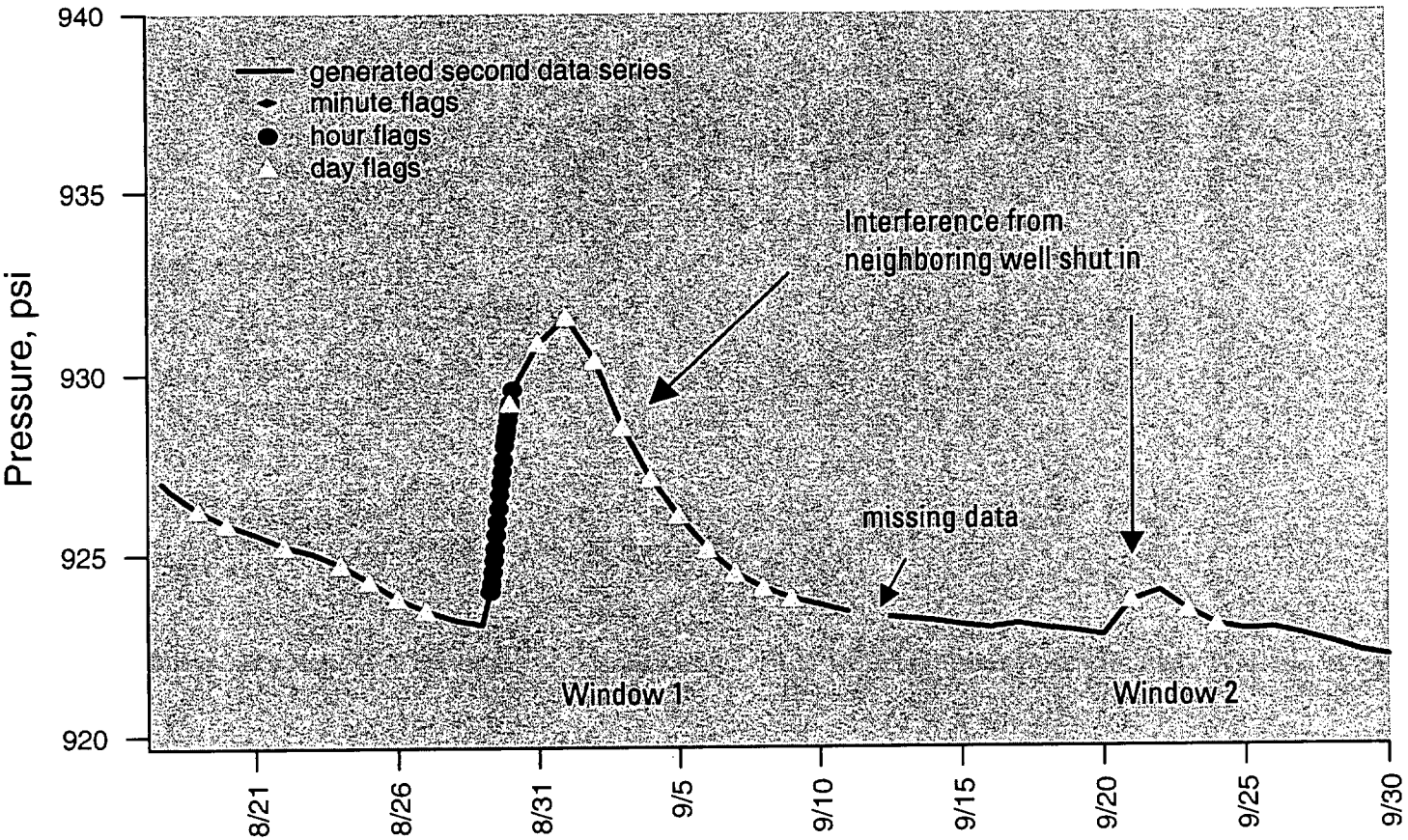
FIG. 6 is a graph showing pressure data stream processed to identify a missing data acquisition period as well as two interesting data windows where effect of shutting a neighboring well is seen.

FIG. 6 shows an example of data processing in accordance with the present invention. A pressure stream from an annular zone of a newly drilled well that has not yet begun producing is shown. Here the first data series is at a second time scale. The annulus is exposed to the formation and hence responds to events in the reservoir. A second data series based on subsets generated from the following criteria:

$\Delta t > 1$ second (identify missing data) or $\Delta t = 1$ day or $|\Delta P/\Delta t| > 0.3$ psi/min or $|\Delta P/\Delta t| > 0.2$ psi/hr or $|\Delta P/\Delta t| > 0.3$ psi/day is displayed over a two-month period. This display shows a daily data series together with flags raised at hour- and day-time scales due to interference from shutting a neighboring well as well as identification of a missing data acquisition period. Note that there are no minute-scale identified transients in this period. There are two interesting data windows in this plot that are caused by two unplanned shut down of a neighboring producer. Window 1 has a history associated with it (downward pressure trend from an earlier operation) and hence cannot be extracted in isolation for pressure transient analysis. Window 2 is a good candidate for more detailed interpretation (see FIG. 7). The user can access the archives to selectively extract these interesting windows of data at a higher time resolution (minute-scale or second-scale) if needed for interpretation. In Window 1, the time of shut down of the neighboring producer was not recorded. In addition, the pressure in the newly drilled well is on a downward trend due to completion operations performed on it and the interference effect is superimposed over this earlier trend. Hence, while qualitatively one can see that there is communication in the formation between these two wells, one cannot isolate this window and send it to a well testing package for a quantitative analysis as it has a history associated with it. The second window has a quiet period preceding the interference, and here the operator recorded the shut-in time. Hence, this window of data could be used to do a more quantitative analysis of the interference as outlined in the Data Interpretation section below.

Data Interpretation:

One of the objectives of real-time monitoring is to gain more knowledge of the reservoir and use that knowledge to manage the reservoir to optimize its performance. While a detailed reservoir simulator coupled to a nodal analysis package may be used to do a complete history match, the time scale involved could be on the order of months. This time scale is much larger than time scale at which decisions have to be made. If the value of real-time sensing is to be realized, data interpretation must be done using criteria of different time scales. At the first level, a quick look interpretation on a day to week scale must yield qualitative information with order of magnitude estimates of properties. This should lead into progressively more detailed interpretation with more sophisticated modeling tools at larger time scales. These levels of interpretation are discussed below.

Level 1: Quick-look data-interpretation involves tracking certain parameters that are easily derived from raw measurements. These parameters are a function of reservoir properties and fluids contained in them. Examples of such interpretations include, but are not limited to: (1) Productivity Index (PI) of a producing zone, (2) pressure diffusion time, (3) pressure drop across choke, and (4) pressure drop in wellbore tubing, each of which will be discussed below.

Productivity Index (PI) of a Producing Zone:

For a reservoir with a strong pressure support, and operating at a constant flow, a drop in bottom-hole pressure could indicate drop in PI.

Pressure Diffusion Time:

Raghuraman and Ramakrishnan describe an example where shutting in an injector (planned and unplanned due to pump failure) in a five-spot water flood, resulted in pressure drop in an observation pressure gauge 233 feet away in *Interference Analysis of Cemented-Permanent-Sensor Data from a Field Experiment*, (*M*019), Jun. 11-15, 2001, EAGE 63rd Conference & Technical Exhibition, Amsterdam (incorporated by reference herein in its entirety). The injection rate (sensor A) and pressure signals (sensors B and C) were scanned for injector shut down events (i.e., criteria were established to process the first data series to create subsets with these identified events). Data windows of these regions were extracted from the first data series to generate second data series for data interpretation. Cross-correlation of the injection pressure and observation pressure signal derivatives in the time domain yielded the pressure diffusion time (or response lag time) between these two points. For a reservoir with low compressibility fluid and negligible wellbore storage, this derived parameter is related to the porosity (ϕ), fluid compressibility (c) and viscosity (μ) and the distance (r) between the two measurement points:

$$T_c \approx \frac{\phi \mu c r^2}{4k} \tag{1}$$

The lag time indicated the existence of a fracture between the injector and observation point. Tracking these lag times (obtained whenever this event occurred) over the one-year period of the experiment indicated that the fracture properties were changing over time (see Table 1 below). This type of interpretation yielded significant information about the reservoir without detailed modeling and is an example of Level 1 interpretation.

TABLE 1

Level 1 interpretation to get pressure response lag times

| Date | Event | Response lag time (min) for shut in | Response lag time (min) for start up |
|---|---|---|---|
| March 26 | fracture | | |
| April 9-10 | planned shut in | 360 | 470 |
| April 12-13 | unplanned shut down | 109 | — |
| Nov 4-11 | planned shut in | — | 50 |

Figure 7:
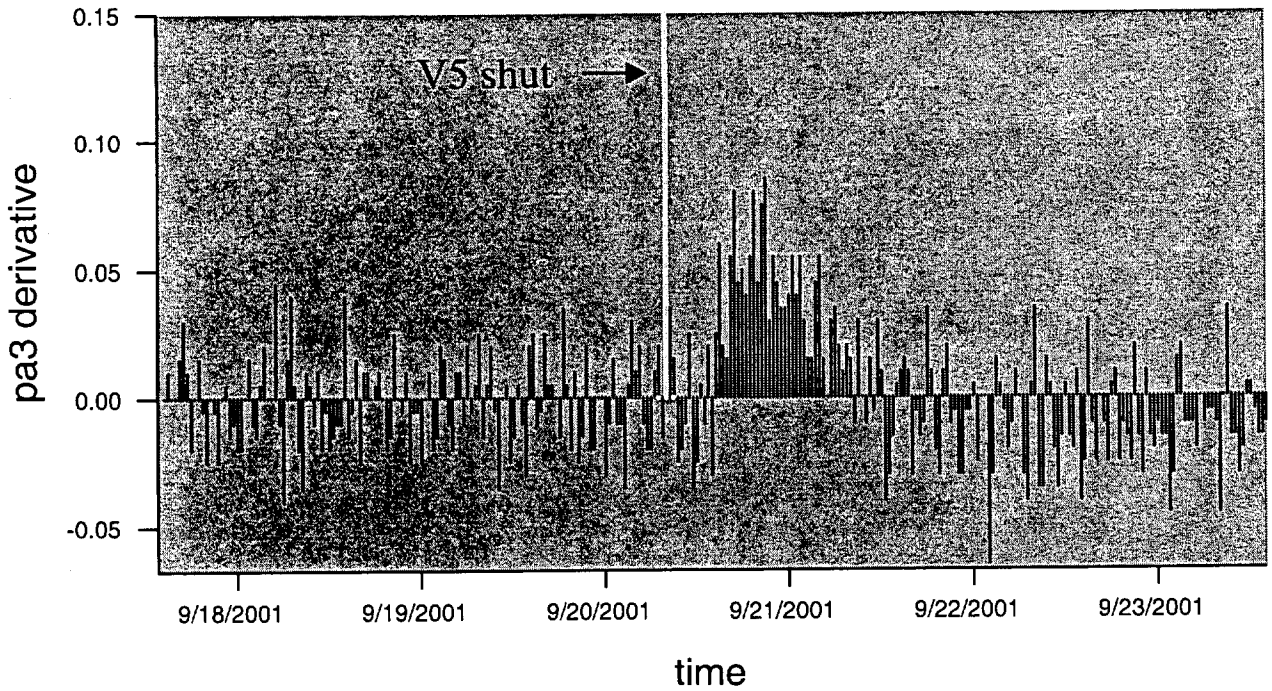
FIG. 7 is a graph showing the Level 1 interpretation of an interesting region (Window 2) identified in FIG. 5.

FIG. 7 is an example of quick look interpretation for the second data window identified in the pressure plot of FIG. 6. The response time lag between the shut down of the neighboring producer (V5) and the peak in the annular pressure signal derivative is about 10 hrs. Eq. 1 is not strictly applicable here due to wellbore storage effects. The time lag is nevertheless an indicator of communication between these two pressure points and will yield an order of magnitude estimate of permeability if other properties are known. The time lag is a characteristic for this system and tracking it over the reservoir lifetime would allow quick detection of changes in the formation or fluid type.

FIGS. 8(*a*) and 8(*b*) show cross plots of annular pressure derivative signals from a three zone well, when the middle annular zone (zone 2) was opened to flow after a shut-in period. Traces dpa1, dpa2, and dpa3 correspond to the pressure derivatives for zones 1, 2, and 3, respectively. Details of this experiment are discussed by Bryant, Chen, Raghuraman, Schroeder, Supp, Navarro, and Raw in *Real-Time Monitoring and Control of Water Influx to a Horizontal Well Using Advanced Completion Equipped With Permanent Sensors*, SPE 77522, Sep. 29-Oct. 2, 2002, SPE Annual Technical Conference and Exhibition, San Antonio (incorporated by reference herein in its entirety). FIG. 8(*a*) shows that this event causes a sharp response in the annulus pressure of the toe zone (zone 3) but there is no response in the pressure of the heel zone (zone 1). This can be interpreted immediately to say that while zones 2 and 3 communicate, there is no communication between zones 1 and 2. Further, the response time lag for zone 3 is about 14 minutes. Again, Eq. 1 is not strictly valid as there are storage effects and a more complicated geometry. The pressure lag time, however, is a characteristic of this system that should be tracked. It can be used to constrain properties in the next level of interpretation, which may use a well testing package or a reservoir simulator. Note that the pressure lag is of the order of hours in FIG. 7, whereas it is on the order of minutes in FIG. 8. This underscores the need to process data at multiple scales.

Pressure Drop Across Choke:

Changing pressure drop across a downhole choke at constant choke setting could be an indicator of change in type of fluid flowing through (single phase to two phase) or change in valve characteristics (scale etc.).

Pressure Drop in Wellbore Tubing:

When distributed tubing pressure measurements are available in the wellbore, they can be used to detect changes in frictional losses in wellbores. Such changes could result, for example, when fluid flow in wellbore changes from single phase to multiphase, or changes in inflow profile along wellbore. This is again a quick look interpretation prior to a more detailed nodal analysis or simulation.

Figure 9:
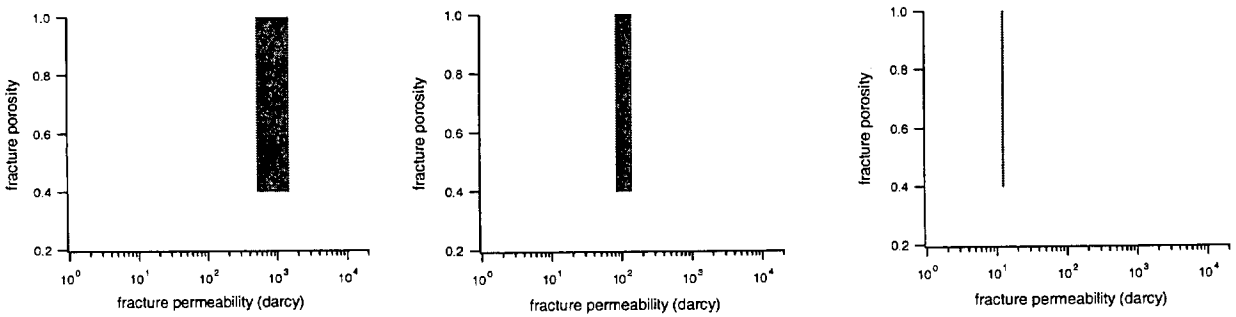
FIGS. 9(*a*), 9(*b*) and 9(*c*) show an example of Level 2 interpretation for the five spot water flood scenario described in text.

Level 2: This could involve using well testing software, nodal analysis or reservoir simulator to run forward models and/or inversion algorithms simulating some of the events identified through data processing of first series. Running multiple forward models could map feasible values for formation properties such that they are able to match derived quantities (such as pressure diffusion time) from Level 1 interpretation. This interpretation is for local events (identified during processing) and is not a full history matching exercise and, hence, can be done at a time scale of a few days. It uses only the relevant region of data surrounding an identified event (subset). FIGS. 9(*a*), 9(*b*) and 9(*c*) show an example of a Level 2 interpretation for the five-spot water flood scenario described above. Multiple forward models were run to map feasible fracture properties using pressure diffusion times (see Table 1 above) and pressure difference between injector and the observation well. Results of Level 1 interpretation (Table 1) and pressure difference between injector and observation point are used to map feasible regions for fracture porosity and permeability for various fracture thicknesses by running multiple forward models. A null set was obtained for a fracture thickness of 0.033 mm.

Level 3: Detailed interpretation would be a full history match using a detailed reservoir model that attempts to do a regression analysis on all measurements or a data set significantly larger than used for Level 2. This exercise may involve coupling the simulator with a nodal package and the time frame would be of the order of months. It is possible that the data may need to be filtered or smoothed before use in well testing software etc.

Example B

Figure 10:
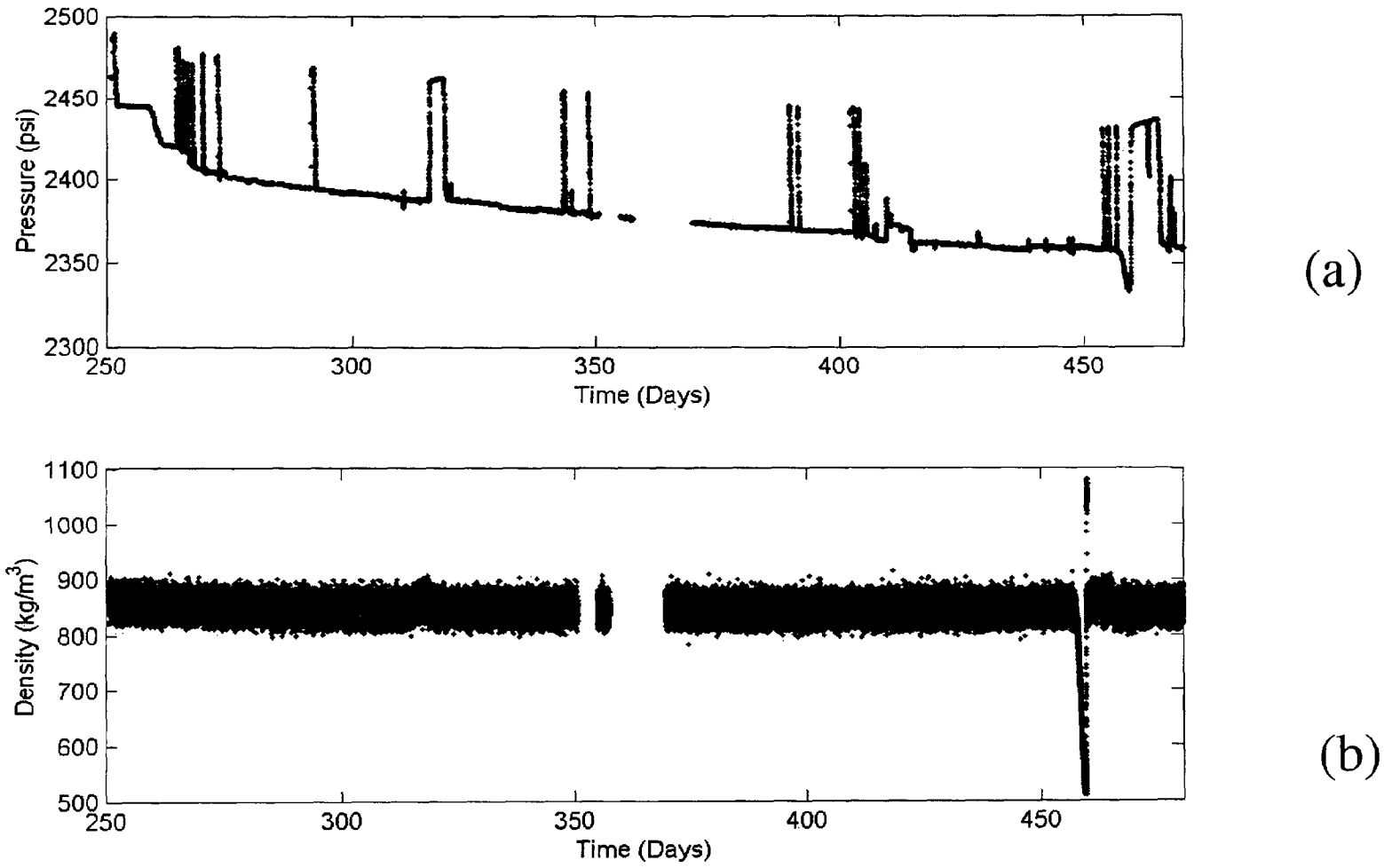
FIGS. 10(*a*) through (*d*) are graphs showing the first data series from pressure and density sensors.
Figure 10:
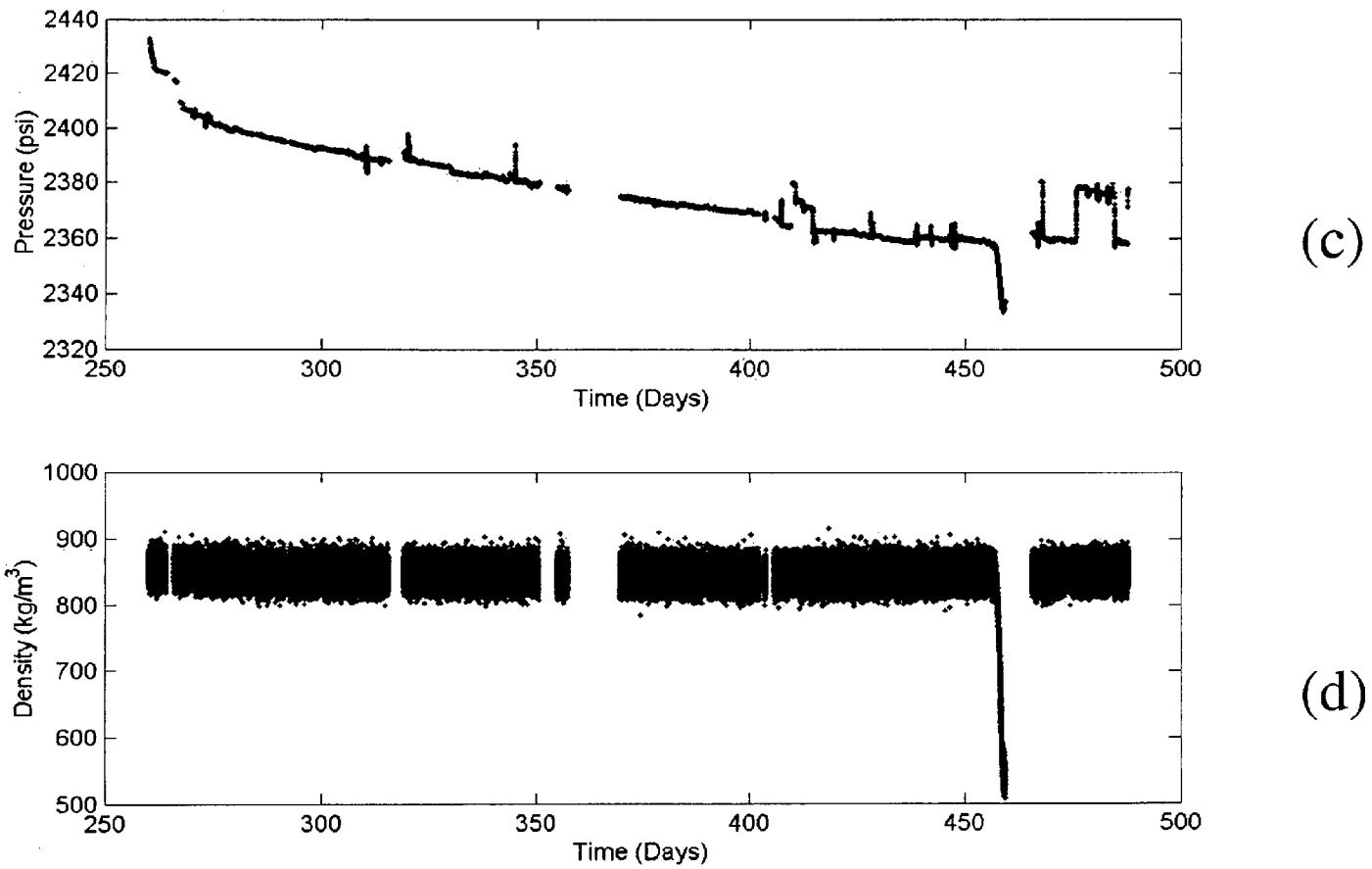

As an example of real-time processing of data from more than one sensor, consider a measurement of both borehole pressure (sensor A) and borehole fluid density (sensor B). Examples of borehole pressure and fluid density measured during well operation are shown in FIGS. 10(*a*) through (*d*) and represent two first data series from different sensors. In particular, consider a fluid density determination based on the well-known technique of measuring the attenuation of gamma-rays through the fluid. The measured attenuation, as is also well-known, is subject to statistical fluctuations, or noise, due to the process of counting gamma-rays in the measurement. Such fluctuations are apparent in FIGS. 10(*a*) and (*b*). Also, it may be important in the process of operating the well and to allow for real time reservoir management, to include in the density measurement only those data taken during stable well operation, and to exclude those data collected during times of unstable well operation, such as shut-ins. However, due to the noise in the density measurement, it may not be possible to determine from the density measurement alone when well operation is unstable. The pressure data, on the other hand, being much less noisy than the density data, can easily determine when the well operation is unstable. Accordingly, a criterion can be set on the magnitude of pressure transients to determine when the well is unstable and identify subsets of the pressure and gamma-ray data that mark the beginning and end of stable periods (i.e. identify the start and stop points). These subsets of data can then be used to process the first data series (i.e. the original data set) to produce pressure and gamma-ray density time series (i.e., two second data series) in regions of stable well operation, where these regions extend between unstable regions. The criteria can be as simple as the magnitude of pressure transients or they can be more complicated.

Figure 11A:
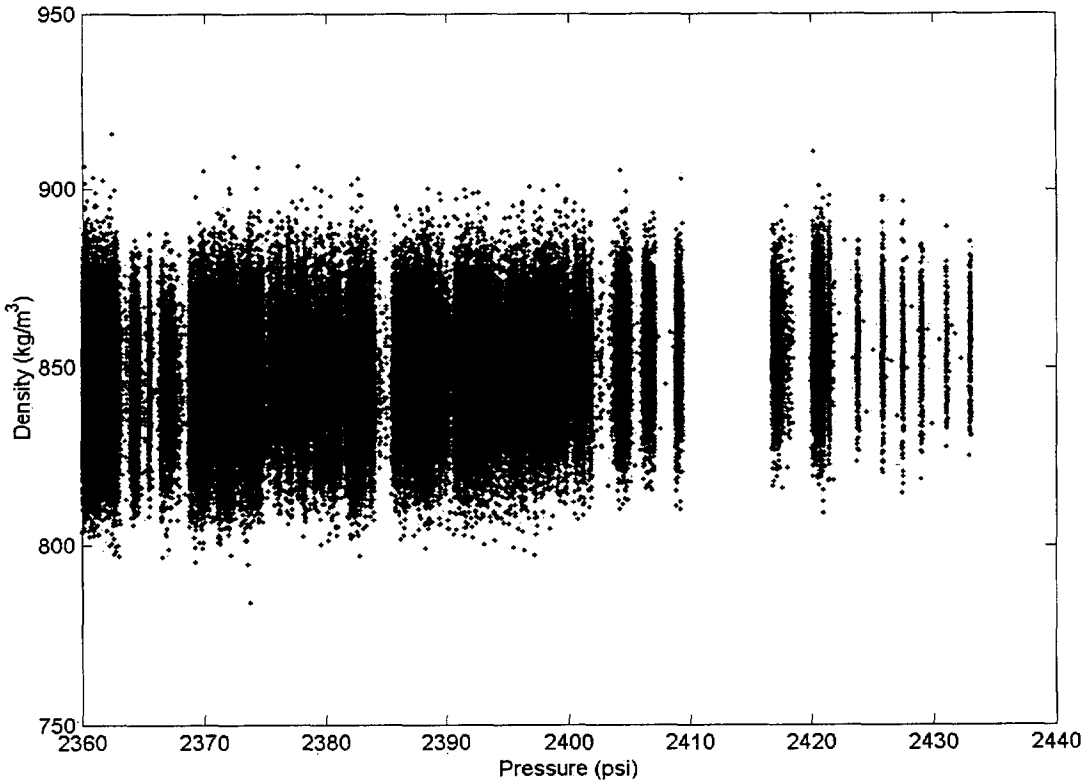
FIGS. 11(*a*) and (*b*) are graphs showing second data series from FIGS. 10(*a*) through 10(*d*).
Figure 11B:
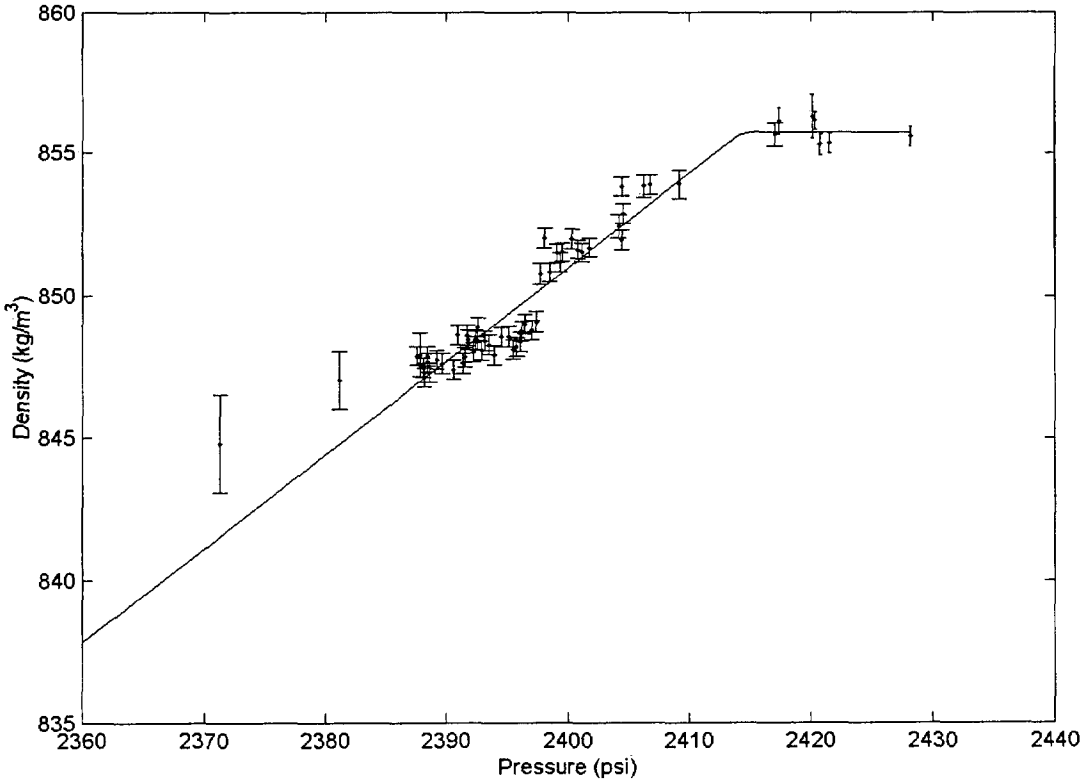

The following example of a more complicated criterion allows the data in the regions of stable well operation to be averaged over the regions of stable well operation, and thereby producing a second data series where the time intervals of the second series are longer than those in the original series. In this case, the criteria for the choice of a suitable time frame (i.e., time intervals) is a function of the maximum allowable change in pressure in that time frame and statistical fluctuations of the gamma ray data, which is known to be a Poisson process. An optimal time frame for processing can be found using simulations of various pressure-density correlation curves. FIGS. 10(*a*) and (*b*) show the first data series pressure and density data accumulated in one-minute time bins. FIGS. 10(*c*) and (*d*) show the data with the stable regions of well operation having been identified based on pressure transients (i.e. the data after transient removal), as discussed previously. FIG. 11(*a*) shows the result of processing the first series according to the stability criterions (i.e., the second data series). In this Figure, density is plotted vs. pressure to examine the interdependence of these two parameters. But due to poor signal to noise ratio, the interdependence of the two parameters is unclear. In FIG. 11(*b*), an additional criterion that an adaptable time dependent bin width for reprocessing has been added. When this additional criterion is added, the second data series now shows the interrelation between pressure and density where, in fact, the fluid drops below the bubble point pressure, leading to gas breakout and a lower density.

While the invention has been described herein with reference to certain examples and embodiments, it will be evident that various modifications and changes may be made to the embodiments described above without departing from the scope and spirit of the invention as set forth in the claims.

What is claimed is:

1. A computer-implemented method for processing raw reservoir data to reduce data size, the method comprising:

i. receiving a first series of raw data as a function of time from a first reservoir sensor;

ii. receiving a second series of raw data as a function of time from a second reservoir sensor;

iii. using a predetermined criteria to identify a plurality of subsets-of-interest within the first series of raw data;

iv. using time intervals associated with the plurality of subsets-of-interest within the first series of raw data to identify corresponding subsets-of-interest within the second series of raw data; and v. generating a third series of data as a function of time using the second series of raw data comprising the corresponding subsets-of-interest, wherein the third series of data comprises a first data resolution for the corresponding subsets-of-interest and a second data resolution that is different from the first data resolution for data outside the corresponding subsets-of-interest.

2. The computer-implemented method of claim 1, wherein the first data resolution is greater than the second data resolution.

3. The computer-implemented method of claim 2, wherein the third series of data omits data outside the corresponding subsets-of-interest.

4. The computer-implemented method of claim 2, wherein the second series of raw data includes an original data resolution and the first data resolution is the same as the original data resolution.

5. The computer-implemented method of claim 1, further comprising:

repeating processes (ii), (iv), and (v) for at least one other reservoir sensor.

6. The computer-implemented method of claim 1, wherein the first reservoir sensor is a valve sensor.

7. The computer-implemented method of claim 1, wherein the second reservoir sensor is a pressure sensor.

8. The computer-implemented method of claim 1, wherein the third series of data comprises averaged data outside the corresponding subsets-of-interest.

9. The computer-implemented method of claim 1, further comprising:

compressing the first series of raw data and the second series of raw data.

10. The computer-implemented method of claim 1, further comprising:

acquiring the second series of raw data from the second reservoir sensor at an acquisition rate.

11. The computer-implemented method of claim 10, further comprising:

temporarily increasing the acquisition rate when the first series of raw data meets the predetermined criteria.

12. The computer-implemented method of claim 1, wherein the predetermined criteria includes a plurality of criteria.

13. The computer-implemented method of claim 1, wherein the predetermined criteria is selected from the group consisting of a threshold temperature,
a threshold pressure,
a threshold pressure gradient,
threshold sensor noise,
an opened valve,
a closed valve, and
some combination thereof.

14. The computer-implemented method of claim 1, further comprising:

adjusting the predetermined criteria.

15. The computer-implemented method of claim 1, further comprising:

time stamping the first series of raw data and the second series of raw data.

16. The computer-implemented method of claim 1, further comprising:

displaying at least a portion of the third series of data using a computer or portable device.

17. The computer-implemented method of claim 1, further comprising:

displaying at least a portion of the third series of data as a plot.

18. The computer-implemented method of claim 1, further comprising:

interpreting at least a portion of the third series of data to derive a reservoir parameter.

19. The computer-implemented method of claim 18, further comprising:

interpreting at least a portion of the third series of data to determine a change in the derived reservoir parameter.

20. The computer-implemented method of claim 18, further comprising:

tracking the derived reservoir parameter.

21. The computer-implemented method of claim 1, further comprising:

generating a fourth series of data as a function of time using the first series of raw data comprising the plurality of subsets-of-interest, wherein the fourth series of data comprises a third data resolution for the plurality of subsets-of-interest and a fourth data resolution that is different from the first data resolution for data outside the plurality of subsets-of-interest.

22. The computer-implemented method of claim 1, wherein (i) a predetermined criteria comprises a joint predetermined criteria, (ii) the joint predetermined criteria is used to identify the plurality of subsets-of-interest within the first series of raw data and to identify a second plurality of subsets-of-interest within the second series of raw data, and (iii) the time intervals associated with the plurality of subsets-of-interest within the first series of raw data and time intervals associated with the second plurality of subsets-of-interest within the second series of raw data are used to identify the corresponding subsets-of-interest within the second series of raw data.

* * * * *